US007017359B2

(12) United States Patent
Kim et al.

(10) Patent No.: US 7,017,359 B2
(45) Date of Patent: Mar. 28, 2006

(54) USER-INTERACTIVE REFRIGERATOR AND CONTROL METHOD THEREOF

(75) Inventors: Chang-nyeun Kim, Seoul (KR); Gun-ho Hong, Kwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/614,091

(22) Filed: Jul. 8, 2003

(65) Prior Publication Data

US 2004/0035123 A1 Feb. 26, 2004

(30) Foreign Application Priority Data

Aug. 23, 2002 (KR) ..... 2002-50239

(51) Int. Cl.
*F25B 49/02* (2006.01)
*G06F 17/00* (2006.01)

(52) U.S. Cl. ..... 62/127; 62/161; 700/236; 700/237; 700/244

(58) Field of Classification Search ..... 62/125, 62/126, 127, 129, 130, 131, 161, 162, 163, 62/164; 236/51, 94; 700/215, 232, 236, 700/237, 244
See application file for complete search history.

(56) References Cited

U.S. PATENT DOCUMENTS 6,393,848 B1 * 5/2002 Roh et al. ..... 62/126
6,519,963 B1 * 2/2003 Maeda ..... 62/259.2
6,658,322 B1 * 12/2003 Frederick et al. ..... 700/236
6,690,997 B1 * 2/2004 Rivalto ..... 700/237
2002/0066279 A1 6/2002 Kiyomatsu

FOREIGN PATENT DOCUMENTS

| | | |
|---|---|---|
| JP | 11-337252 | 12/1999 |
| JP | 2000-65465 | 3/2000 |
| JP | 2000-111238 | 4/2000 |
| JP | 2001-91143 | 4/2001 |
| JP | 2002-39669 | 2/2002 |
| JP | 2002-41901 | 2/2002 |
| JP | 2002-81818 | 3/2002 |
| JP | 2002-92120 | 3/2002 |
| JP | 2002-107052 | 4/2002 |
| JP | 2002-221387 | 8/2002 |
| KR | 1997-0011732 | 3/1997 |
| KR | 2000-0064095 | 11/2000 |
| KR | 2001-81143 | 4/2001 |
| KR | 2001-0092059 | 10/2001 |

OTHER PUBLICATIONS

Japanese Office Action for Patent Application 2003-030032 dated Jul. 19, 2005.

* cited by examiner

*Primary Examiner*—Harry B. Tanner
(74) *Attorney, Agent, or Firm*—Staas & Halsey LLP

(57) ABSTRACT

A refrigerator having a cooling compartment provides a memory storing data about a user and data on food items stored in the cooling compartment; a user recognition device recognizing a present user; a controller reading the food item data corresponding to the user data relevant to the present user recognized by the user recognition device; and a display displaying the food item data read by controller. Thus, the refrigerator may be provided, which displays food item information appropriate to a user and reflecting the user's taste, physical constitution and health condition.

18 Claims, 5 Drawing Sheets

USER-INTERACTIVE REFRIGERATOR AND CONTROL METHOD THEREOF

CROSS-REFERENCE TO RELATED APPLICATIONS

This application claims the benefit of Korean Application No. 2002-50239, filed Aug. 23, 2002, in the Korean Industrial Property Office, the disclosure of which is incorporated herein by references.

BACKGROUND OF THE INVENTION

1. Field of the Invention

The present invention relates to a refrigerator, and more particularly, to a refrigerator having a display for displaying food item information which a user wants and a control method thereof.

2. Description of the Related Art

These days, large-sized refrigerators with various functions have been produced to satisfy the demand of a consumer. For example, there is a refrigerator having a dispenser for giving a user potable water without opening its door.

Furthermore, it will be very convenient to provide a refrigerator which provides various food item information satisfying consumers' demands, for example, suitable for a user's taste or health condition, etc., and thus, the refrigerator will provide a user with more convenience.

SUMMARY OF THE INVENTION

Accordingly, it is an aspect of the present invention to provide a refrigerator which provides a user with desired food item information and a control method thereof.

Additional objects and advantages of the invention will be set forth in part in the description which follows and, in part, will be obvious from the description, or may be learned by practice of the invention.

The foregoing and/or other aspects of the present invention are achieved by providing a refrigerator having a cooling compartment comprising a memory storing data about a user and data on food items stored in the cooling compartment; a user recognition device recognizing a present user; a controller reading the food item data corresponding to the user data relevant to the present user recognized by the user recognition device; and a display displaying the food item data read by the controller.

Herein, it is desirable that the user recognition device includes biometric technologies such as a finger-scan device, a facial-scan, or an iris-scan device.

Also, it is desirable that the user data includes at least one of a list of food items that the user prefers and data on a physical constitution data of the user. Herein, it is effective that the physical constitution data includes a list of food items which are classified according to the physical constitution.

The refrigerator may further comprise a health information input device inputting the user's health information. Herein, the user data further includes a list of food items which are classified according to the health condition. Herein, it is desirable that the health information input device includes at least one among a device measuring a user's pulse frequency, a device measuring the user's blood sugar level and a device measuring the user's weight.

The refrigerator may further comprise a food item information input device inputting the information data on food items. Herein, it is effective that the food item information input device includes a bar code reader reading a bar code prepared on the food items stored in the cooling compartment.

The refrigerator may further comprise a food item information deleting device recognizing the food items which are taken out from the cooling compartment. And it is desirable that the controller deletes the food item data on the food items read by the food item information deleting device from the memory. Herein, it is desirable that the food item information deleting device includes a bar code reader reading a bar code prepared on the food items.

Also, it is desirable that the food item data includes at least one among a list of food items stored in the cooling compartment, a storage period, the number of each food item, a storage position, and a nutrient of each food item.

The foregoing and/or other aspects of the present invention may be also achieved by providing a method of inputting health information on a user into a refrigerator comprising storing data on a user; recognizing a present user; inputting the health information on the present user; confirming whether there is health information on the recognized present user in the user data; and updating the health information on the present user into the user data, in the case that there is the health information on the present user in the user data.

The method of inputting health information on a user into a refrigerator further comprises confirming whether the present user's health information is approved to be stored in the case that there isn't the health information data of the present user; and storing the health information on the present user into the user data in the case that there is the approval of the storage of the present user's health information.

BRIEF DESCRIPTION OF THE DRAWINGS

These and other objects and advantages of the present invention will become apparent and more readily appreciated from the following description of the embodiments, taken in conjunction with the accompany drawings of which.

DETAILED DESCRIPTION OF THE PREFERRED EMBODIMENTS

Figure 1:
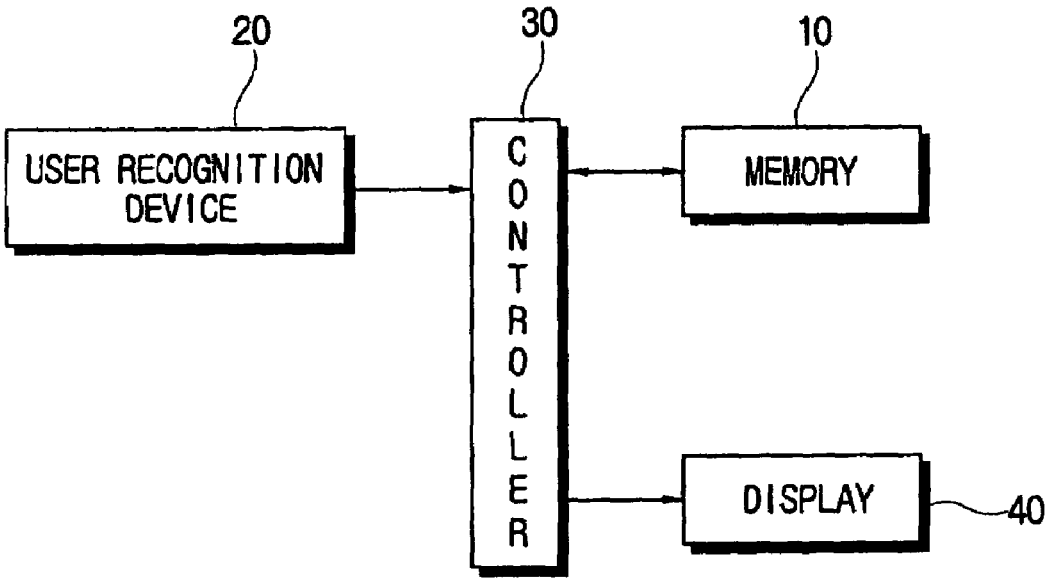
FIG. 1 is a block diagram of a refrigerator according to a first embodiment of the present invention.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Generally, a refrigerator has a cooling compartment (not shown) such as a refrigerator compartment and a freezer compartment for storing food items, a door opening/closing the cooling compartment and a cooling system cooling the inside of the cooling compartment.

A refrigerator according to a first embodiment of the present invention, as shown in FIG. 1, comprises a memory 10 storing data about a user and data about food items, a user recognition device 20 recognizing a user using the refrigerator (hereinafter, referred to as "present user"), a controller 30 reading the food item data corresponding to the user data on the present user recognized by the user recognition device 20 and a display 40 displaying the food item data read by the controller 30.

The food item data stored in the memory 10 comprises the list of food items stored in the cooling compartment, a storage period, the number of each food item, and a storage position and information on each food item such as calorie or nutrient.

The user recognition device 20 recognizes a user who wants to use the refrigerator now. Also, the user recognition device 20 is connected electrically to the controller 30 and transmits the information on the present user to the controller 30. The user recognition device 20 according to the present invention desirably uses biometric technologies including a finger-scan device, a facial-scan device, or an iris-scan device, but of course may use other user-recognition technologies.

In the case of the finger-scan device, it may be located at a predetermined place in the body of the refrigerator, for example, at a doorknob of the refrigerator. In this case, if a user grips the doorknob to open the door of the refrigerator, the finger-scan device captures images of the present user's fingerprint features and transmits the images thereof to the controller 30. Likewise, the iris-scan device or the facial-scan device may be located at a predetermined place in the front of the refrigerator and captures images of the present user's iris features or facial features and transmits the images thereof to the controller 30.

The user data stored in the memory 10 includes information on fingerprint features, facial features or iris features of the present user, the list of food items that a user prefers and data on a physical constitution of a user. Herein, the physical constitution data may include the list of food items appropriate to each physical constitution.

The user data can be stored in the memory 10 in advance when refrigerators are produced. Alternatively, the user data can be input by an input device and then stored in the memory 10.

The controller 30 is electrically connected to the memory 10, the user recognition device 20 and the display 40 and reads the information about the present user recognized by the user recognition device 20 from the memory 10 and transmits the information into the display 40.

Figure 2:
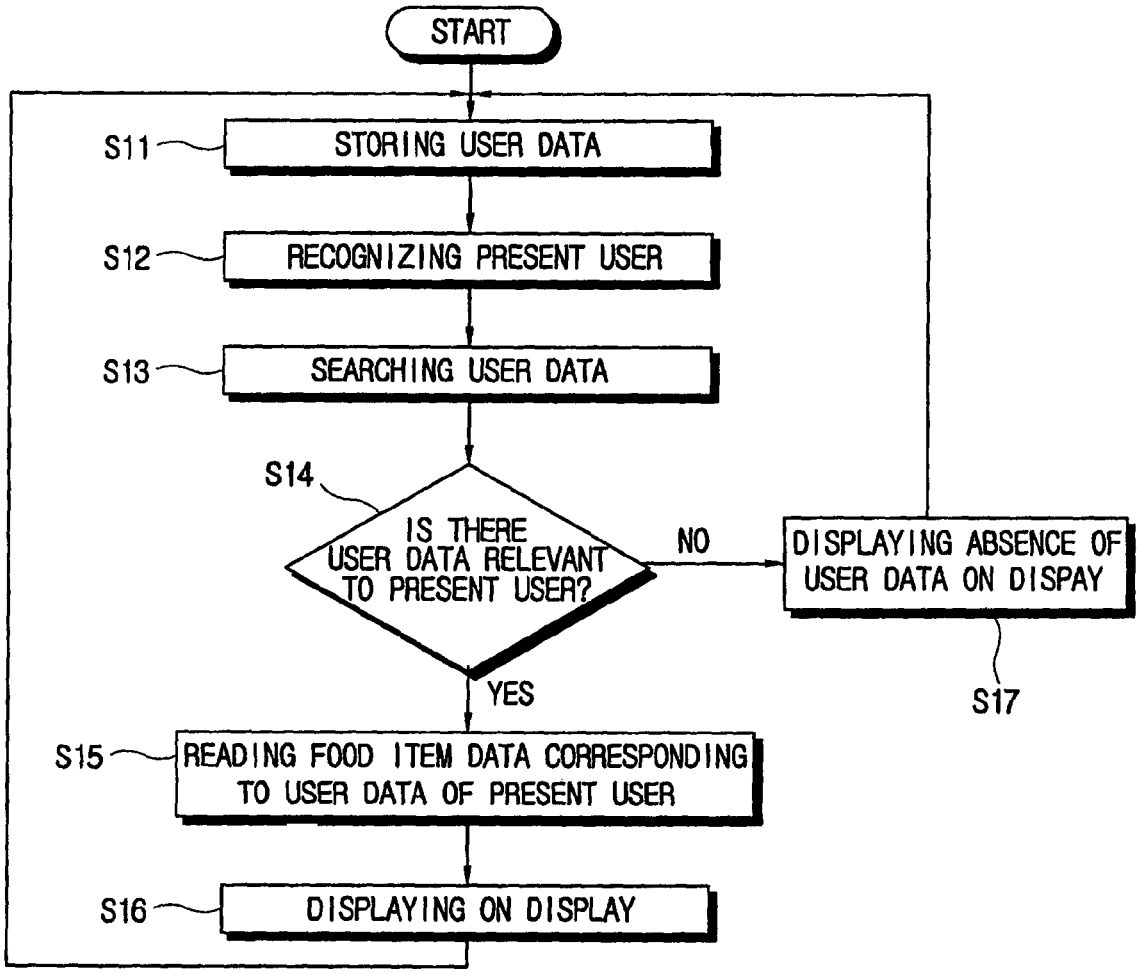
FIG. 2 is a flow chart of the refrigerator according to the first embodiment of the present invention.

With the above configuration, in the case that a user takes food items from a refrigerator, a control process of the refrigerator will be described in more detail with reference to FIG. 2 as follows.

At first, user data and food item data are stored in the memory 10 (S11). In this state, when a user uses the refrigerator, the user recognition device 20 recognizes the present user (S12). The information on the present user recognized by the recognition device 20 is transmitted to the controller 30 and the controller 30 searches the user data stored previously in the memory 10 (S13). Then, the controller 30 confirms if there is the user data relevant to the present user (S14). In the case that there is the user data relevant to the present user in the memory 10, the controller 30 reads the food item data corresponding to the user data of the present user (S15). Then, the controller 30 displays the searched food item data on the display 40 (S16). Then, the controller 30 returns to the operation of storing user data and food item data in the memory (S11).

In the case that there is not the user information data relevant to the present user in the memory 10, the controller 30 displays on the display 40 the absence of the user data relevant to the present user in the memory 10 (S17). Then, the controller 30 returns to the operation of storing user data and food items in the memory (S11). Thus, the present user is able to obtain information on food items which he/she prefers among the food items displayed on the display 40, the list of food items appropriate to his/her physical constitution, the storage period and the storage position of the food items.

Figure 3:
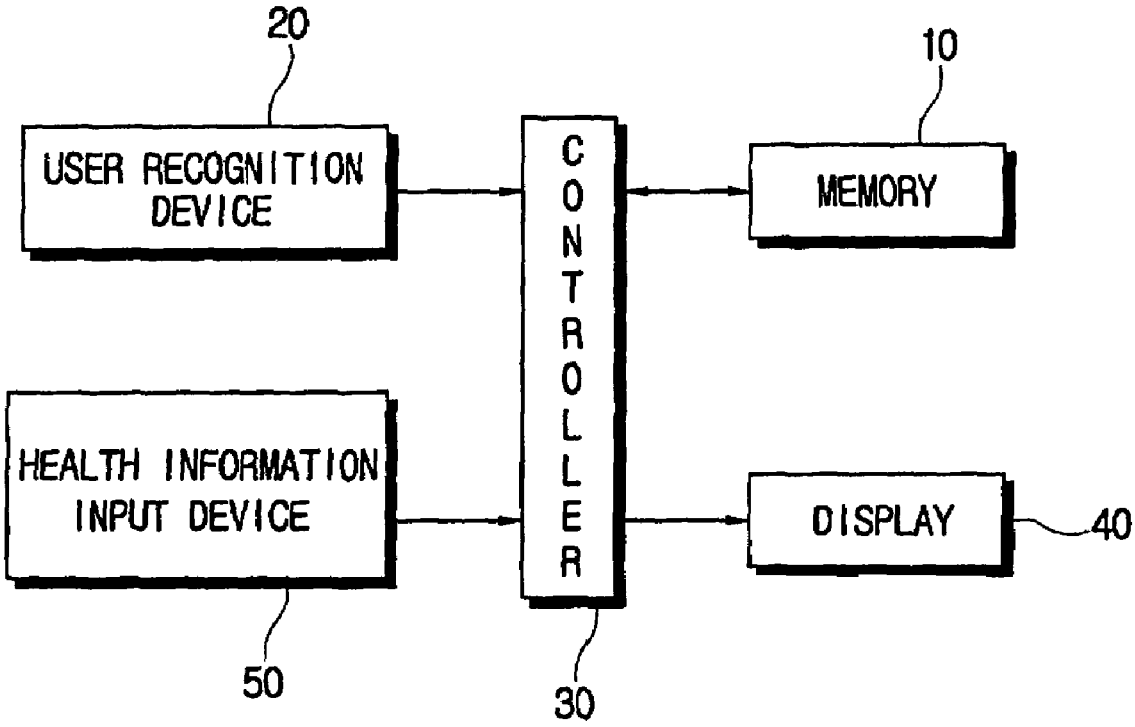
FIG. 3 is a block diagram of the refrigerator according to a second embodiment of the present invention.

FIG. 3 is a schematic block diagram of a refrigerator according to a second embodiment of the present invention. As shown in FIG. 3, the refrigerator according to the second embodiment of the present invention further comprises a health information input device 50. In this regard, the user data further includes the list of food items which are classified appropriately on the basis of the health information.

The health information input device 50 may include one of a pulsimeter measuring a user's pulse frequency, a glucose meter measuring the user's blood sugar level and a scale measuring the user's weight. Also, the user data includes the list of food items which are classified appropriately on the basis of the health information, i.e., the pulse frequency, the blood sugar level and the weight, etc., of a user.

Figure 4:
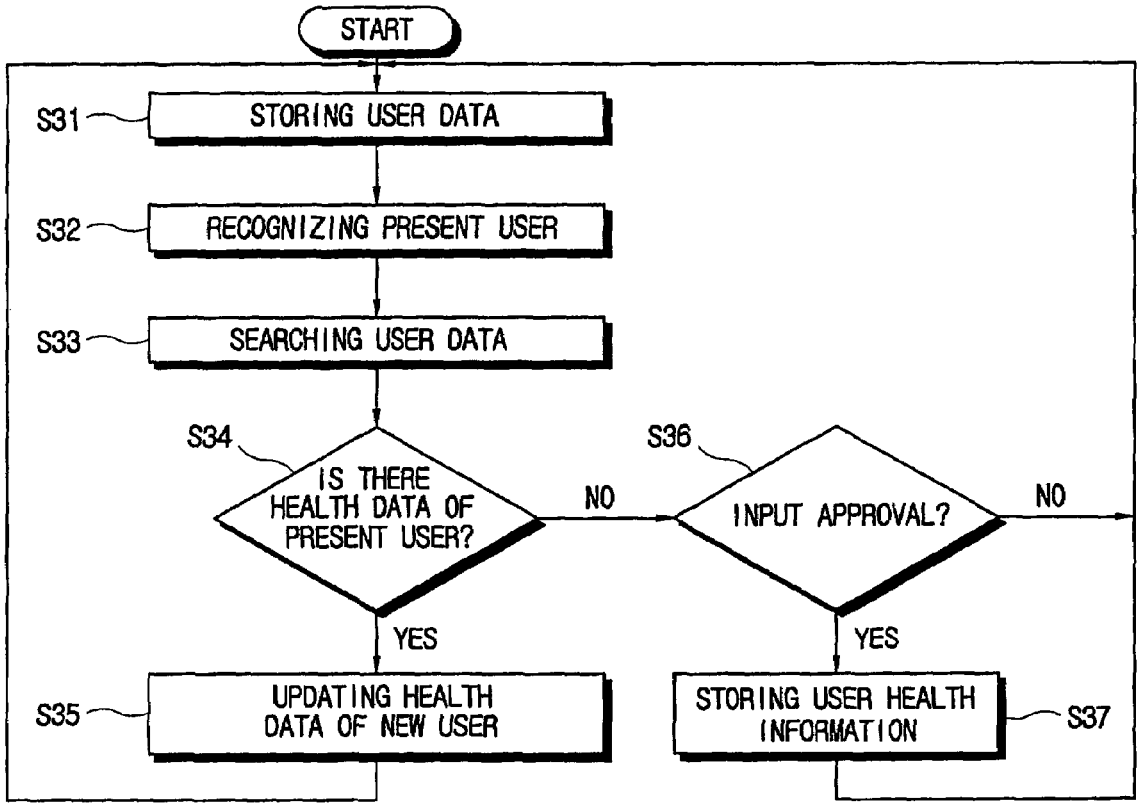
FIG. 4 is a flow chart for a health information input control of the refrigerator according to the second embodiment of the present invention.

With the above configuration, a process that the user data is input and stored will be described in more detail with reference to FIG. 4 as follows.

At first, the user data is stored in the memory (S31). In this state, the user recognition device 20 recognizes the present user (S32). The information on the present user recognized by the recognition device 20 is transmitted to the controller 30, and then the controller 30 searches the user's health data stored previously in the memory 10 (S33). Then, the controller 30 confirms if there is the health data relevant to the present user (S34). In the case that there is the health data in the memory 10, the controller 30 receives the health information on the present user input by the health information input device 50 and updates the information thereof as new health data (S35) and returns to the operation of storing user data (S31).

In the meanwhile, in the case that there is not the health data on the present user in the memory 10, the controller 30 asks the present user whether or not he/she approves that the health information on the present user is stored (S36). Herein, the controller 30 displays on the display 40 whether or not the present user approves that the health information on the present user is stored. The present user can approve that the health information on the present user is stored by use of a key operation device or a touch screen prepared on the display 40. If the controller 30 receives the user's approval for the storage of the health information on the present user, the controller 30 stores the health information on the present user inputted through the health information input device 50 in the memory 10 (S37) and returns to the operation of storing user data (S31). If not, the controller 30 terminates the step of inputting the health information and returns to the operation of storing user data (S31).

In the meanwhile, the health data of the user is stored in the memory 10 in connection with the food item data. Thus, in the case that the user uses the refrigerator, the controller 30 reads the food items appropriate to the user's health condition from the list of food items on the basis of the health data on the present user recognized by the recognition device 20. Then, the controller 30 reads the food items according to the health condition from the list of the food items and displays the read food items on the display 40. Thus, the food items appropriate to the present user's health condition among the food items stored in the refrigerator can be displayed on the display 40.

Figure 5:
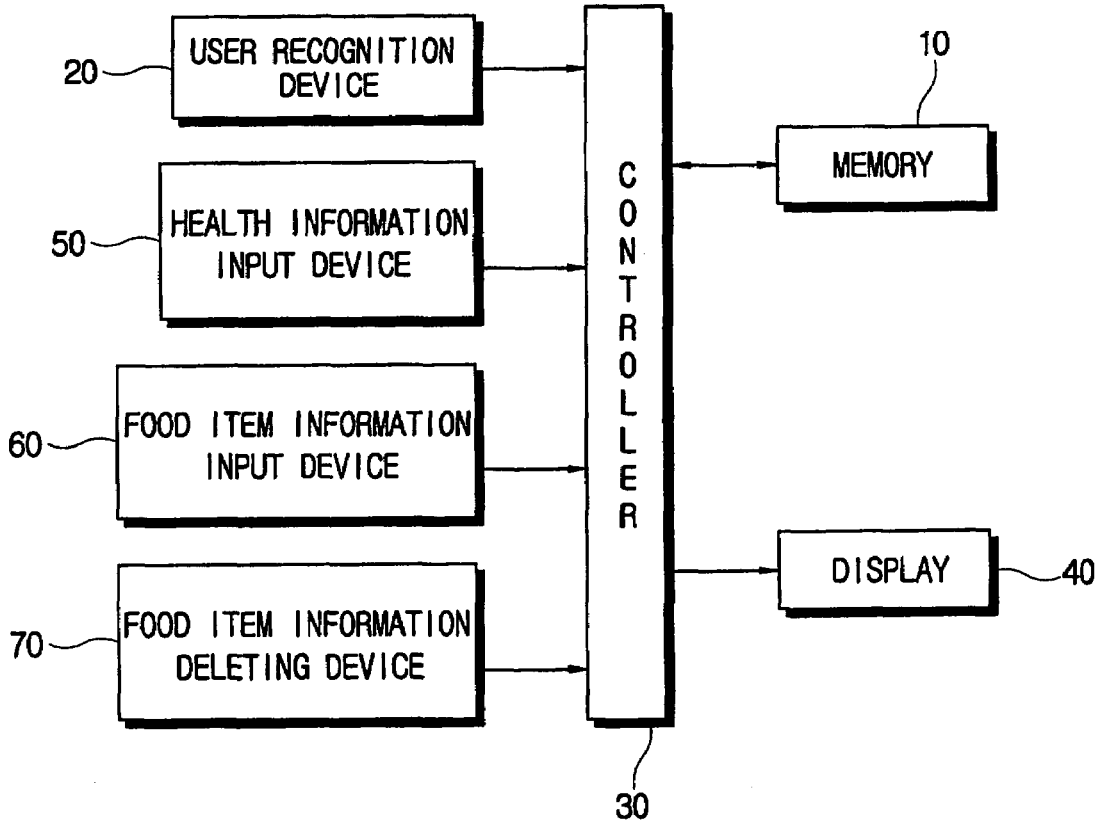
FIG. 5 is a block diagram of the refrigerator according to a third embodiment of the present invention.

As shown in FIG. 5, a refrigerator according to a third embodiment of the present invention further comprises a food item information input device 60 for inputting the information on food items to be stored in the refrigerator. For example, a device such as a bar code reader reading a bar code prepared on food items can be used as the food item information input device 60. Thus, in the case of storing food items in the refrigerator, the bar code reader reads the bar code of the food items, and the controller 30 stores food item data on the read food items in the memory 10. As a result, the food item data can be inputted automatically when the food items are stored.

The refrigerator according to the third embodiment of the present invention may also further comprise a food item information deleting device 70 recognizing that food items are taken out from the refrigerator. The controller 30 deletes the data on food items read by the food item information deleting device 70 from the memory 10. As a result, accurate data on the stored food items can be provided to a user. Herein, a device such as a bar code reader reading a bar code prepared on food items can be used as the food item information deleting device 70.

As described above, by recognizing a present user and displaying food items appropriate to the present user on the basis of the user data and the food item data, the present invention can provide the user with greater convenience.

Further, by inputting the user's health information automatically and displaying food items on the basis of the input health information, the food item information appropriate to the user's health condition can be provided.

As described above, according to the present invention, a refrigerator may be provided, which displays food item information appropriate to a user and reflecting the user's taste, physical constitution and health condition.

Although a few preferred embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a cooling compartment comprising:

a memory storing user data about a user and food item data on food items stored in the cooling compartment;

a user recognition device recognizing a present user, wherein the user recognition device includes a biometric technology;

a controller reading the food item data corresponding to the user data relevant to the present user recognized by the user recognition device from the memory;

a display displaying the food item data read by the controller, and a health information input device that includes at least one among a device measuring a pulse frequency of the present user, a device measuring a blood sugar level of the present user and a device measuring a weight of the present user.

2. The refrigerator of claim 1, wherein the biometric technology is one of: a finger-scan device, a facial-scan, and an iris-scan device.

3. The refrigerator according to claim 1, wherein the user data includes at least one of a list of food items that the present user prefers and data on a physical constitution data of the present user.

4. The refrigerator according to claim 3, wherein the physical constitution data includes a list of food items which are classified according to the physical constitution.

5. The refrigerator according to claim 1, wherein the user data further includes a list of food items which are classified according to the health condition.

6. The refrigerator according to claim 1, further comprising a food item information input device inputting information data on the food items.

7. The refrigerator according to claim 6, wherein the food item information input device comprises a bar code reader reading a bar code on the food items stored in the cooling compartment.

8. The refrigerator according to claim 6, further comprising a food item information deleting device recognizing the food items which are taken out from the cooling compartment, wherein the controller deletes the food item data on the food items read by the food item information deleting device from the memory.

9. The refrigerator according to claim 8, wherein the food item information deleting device includes a bar code reader reading a bar code prepared on the food items.

10. The refrigerator according to claim 1, wherein the food item data includes at least one among a list of food items stored in the cooling compartment, a storage period, the number of each food item, a storage position, and a nutrient of each food item.

11. A user-interactive refrigerator having a cooling compartment comprising:

a user recognition device; and a health information system, reading, storing and displaying health information of a present user and data on food items stored in the cooling compartment corresponding to the health information of the present user, wherein the user recognition device includes a biometric technology, wherein the health information of the present user includes at least one of: a pulse frequency, a blood sugar level, and a body weight.

12. The user-interactive refrigerator according to claim 11 wherein the health information system comprises:

a controller reading the data on food items corresponding to the health information;

a memory storing the health information of the present user and the data on the food items; and a display displaying the health information and the data on the food items read by the controller.

13. The user-interactive refrigerator of claim 11, wherein the health information system further includes:

a health information input device inputting health information of the user.

14. The user-interactive refrigerator of claim 11, wherein the health information system further includes:

a food item information input device inputting information data on the food items.

15. The user-interactive refrigerator of claim 14, wherein the food item information input device includes a bar code reader reading a bar code prepared on the food items stored in the cooling department.

16. The user-interactive refrigerator of claim 11 wherein the health information system further includes:

a food item information deleting device recognizing the food items which are taken out from the cooling compartment, wherein the controller deletes the food item data on the food items read by the food item information deleting device from the memory.

17. The user-interactive refrigerator of claim 11 wherein the data on the food items includes the health information of the food items corresponding to a health condition of the present user.

18. A user-interactive refrigerator having a cooling compartment comprising:

a biometric user recognition device; and a health information device, reading, storing and displaying: a pulse frequency, a blood sugar level, a body weight of a present user, or a combination of at least two thereof and corresponding stored food item data.

* * * * *